US009908234B2

(12) United States Patent
Fuchs et al.

(10) Patent No.: US 9,908,234 B2
(45) Date of Patent: Mar. 6, 2018

(54) PORTABLE POWER TOOL

(71) Applicant: Robert Bosch GmbH, Stuttgart (DE)

(72) Inventors: Rudolf Fuchs, Neuhausen (DE); Florian Bantle, Gruibingen (DE)

(73) Assignee: Robert Bosch GmbH, Stuttgart (DE)

( * ) Notice: Subject to any disclaimer, the term of this patent is extended or adjusted under 35 U.S.C. 154(b) by 513 days.

(21) Appl. No.: 14/076,338

(22) Filed: Nov. 11, 2013

(65) Prior Publication Data

US 2014/0144663 A1 May 29, 2014

(30) Foreign Application Priority Data

Nov. 28, 2012 (DE) ..... 10 2012 221 748

(51) Int. Cl.

| | |
|---|---|
| ***E21B 3/00*** | (2006.01) |
| ***E21B 17/22*** | (2006.01) |
| ***E21B 19/16*** | (2006.01) |
| ***E21B 19/18*** | (2006.01) |
| ***B25F 5/02*** | (2006.01) |
| ***B25F 5/00*** | (2006.01) |

(52) U.S. Cl.

CPC ..... *B25F 5/02* (2013.01); *B25F 5/008* (2013.01)

(58) Field of Classification Search

CPC ..... B25F 5/02–5/029

USPC ... 173/216, 47, 162.1, 162.2, 168, 170, 171; 600/568

See application file for complete search history.

(56) References Cited

U.S. PATENT DOCUMENTS

| | | | | | |
|---|---|---|---|---|---|
| 4,448,098 | A * | 5/1984 | Totsu | B25B 15/04 | 81/467 |
| 4,612,999 | A * | 9/1986 | Bergler | B25D 11/062 | 173/109 |
| 5,054,563 | A * | 10/1991 | Zapf | B25B 21/00 | 173/217 |
| 5,443,196 | A * | 8/1995 | Burlington | B25C 1/06 | 173/124 |
| 5,533,581 | A * | 7/1996 | Barth | B23Q 5/045 | 173/216 |
| 5,697,456 | A * | 12/1997 | Radle | B25F 5/006 | 173/162.2 |
| 6,123,158 | A * | 9/2000 | Steffen | H02K 11/33 | 173/117 |
| 6,189,217 | B1 * | 2/2001 | Melvin | B23D 51/03 | 30/125 |
| 6,244,358 | B1 * | 6/2001 | Beer | B25B 21/00 | 173/170 |

(Continued)

FOREIGN PATENT DOCUMENTS

| | | |
|---|---|---|
| CN | 102039582 A | 5/2011 |
| CN | 102672682 A | 9/2012 |
| JP | 2009-166147 A | 7/2009 |

OTHER PUBLICATIONS

"OSH Answers: Tool Design", Feb. 15, 2005, Canadian Centre for Occupational Health & Safety, http://www.ccohs.ca/oshanswers/ergonomics/handtools/tooldesign.html.*

*Primary Examiner* — Robert Long

(74) *Attorney, Agent, or Firm* — Maginot, Moore & Beck LLP

(57) ABSTRACT

A portable power tool has at least one actuating element and at least one tool holding unit. A center axis of the at least one tool holding unit is configured to extend at least through a vicinity of the at least one actuating element.

16 Claims, 6 Drawing Sheets

(56) References Cited

U.S. PATENT DOCUMENTS 6,286,611 B1 * 9/2001 Bone ..... B25F 3/00 173/170
6,315,060 B1 * 11/2001 Schuda ..... B23Q 5/027 173/115
6,446,734 B1 * 9/2002 Williams ..... B25F 5/02 173/1
6,997,367 B2 * 2/2006 Hu ..... B25C 1/06 173/202
7,174,972 B2 * 2/2007 Kristen ..... B25F 5/006 173/112
7,223,195 B2 * 5/2007 Milbourne ..... B23B 45/008 173/178
7,861,796 B2 * 1/2011 DeCicco ..... B25B 21/00 173/1
7,967,079 B2 * 6/2011 Stierle ..... B25F 5/006 173/162.2
8,407,902 B2 * 4/2013 Naughton ..... B23D 49/11 30/392
8,695,725 B2 * 4/2014 Lau ..... B25F 3/00 173/170
2003/0225344 A1 * 12/2003 Miller ..... A61B 10/025 600/568
2004/0104033 A1 * 6/2004 Schmid ..... B25D 16/00 173/117
2004/0200628 A1 * 10/2004 Schmitzer ..... B25D 16/006 173/1
2005/0082334 A1 * 4/2005 Hu ..... B25C 5/15 227/131
2005/0247466 A1 * 11/2005 Andriolo ..... B25F 5/02 173/170
2006/0060365 A1 * 3/2006 Kunz ..... B25D 17/00 173/48
2006/0124331 A1 * 6/2006 Stirm ..... B25F 5/00 173/178
2006/0219418 A1 * 10/2006 Arakawa ..... B25D 17/043 173/162.2
2006/0289183 A1 * 12/2006 Schreiber ..... B25F 5/006 173/162.2
2008/0314610 A1 * 12/2008 Meixner ..... B25D 11/062 173/216
2009/0314507 A1 * 12/2009 Iwakami ..... B25D 17/043 173/162.2
2011/0011608 A1 * 1/2011 Saur ..... B25D 11/062 173/162.2
2011/0120740 A1 * 5/2011 Moreno ..... B25D 17/043 173/162.2
2011/0278035 A1 * 11/2011 Chen ..... H02P 23/20 173/170
2011/0308829 A1 * 12/2011 Yang ..... B25C 1/06 173/128
2012/0016399 A1 * 1/2012 Poulsen ..... A61B 17/32075 606/170
2012/0145427 A1 * 6/2012 Fuchs ..... B23B 45/001 173/216
2012/0152580 A1 * 6/2012 Mattson ..... B25B 21/00 173/94
2012/0234570 A1 * 9/2012 Machida ..... B23Q 11/0046 173/197
2012/0255756 A1 * 10/2012 Aoki ..... B24B 23/02 173/178
2013/0008677 A1 * 1/2013 Huifu ..... B25F 3/00 173/29
2014/0144664 A1 * 5/2014 Fuchs ..... B25F 5/001 173/216
2014/0166326 A1 * 6/2014 Le Du ..... B25B 21/02 173/181
2014/0321930 A1 * 10/2014 Dengler ..... B23B 45/02 408/8
2014/0352994 A1 * 12/2014 Yoshikane ..... B25D 17/04 173/162.2
2015/0000950 A1 * 1/2015 Blum ..... B25F 5/001 173/213
2015/0041166 A1 * 2/2015 Van Der Linde ..... B25F 3/00 173/29
2015/0114675 A1 * 4/2015 Kraus ..... B23B 45/008 173/178
2015/0151415 A1 * 6/2015 Saitou ..... B25B 21/00 173/93
2015/0328760 A1 * 11/2015 Ikuta ..... B25D 11/00 173/117

* cited by examiner

PORTABLE POWER TOOL

This application claims priority under 35 U.S.C. § 119 to patent application no. DE 10 2012 221 748.7, filed on Nov. 28, 2012 in Germany, the disclosure of which is incorporated herein by reference in its entirety.

BACKGROUND

Portable power tools, in particular battery-powered power tools, in which a center axis of a tool holding unit extends through an upper housing, wherein a downwardly protruding handle is fastened to the upper housing, are already known. An actuating element for switching the battery-powered power tool on and off is fastened to the handle.

SUMMARY

The disclosure proceeds from a portable power tool, in particular a battery-powered power tool, having at least one actuating element and at least one tool holding unit. A "portable power tool" should be understood in particular as meaning a power tool which can be guided with one or both hands of an operator and is different in particular from a stationary power tool. A "battery-powered power tool" should be understood in particular as meaning a portable power tool which is supplied with power by a rechargeable battery and/or battery and is preferably guided with one hand, wherein two-handed guidance may be provided in order to stabilize the battery-powered power tool during use. For example, the battery-powered power tool may be configured as a battery-powered drill, a battery-powered hammer drill, a battery-powered percussion drill, a battery-powered percussion screwdriver or preferably as a battery-powered screwdriver. Preferably, the portable power tool, in particular the battery-powered power tool, is configured in a pistol form. A "pistol form" should be understood in particular as meaning a form of the portable power tool having a handle, in which the portable power tool can be guided with one hand on the handle and the actuating element can be operated with the fingers of a hand grasping the handle, without releasing a grip needed for guiding the portable power tool. An "actuating element" should be understood in particular as meaning an element by means of which function setting of a portable power tool, in particular a battery-powered power tool, can be carried out, in particular switching the portable power tool on or off or setting power values of the portable power tool. Preferably, the actuating element is configured as a pressure switch and particularly preferably as a trigger switch. In principle, the actuating element may also be configured in some other way, for example as a rotary switch or as a touch display. A "trigger switch" should be understood in particular as meaning a switch configured in the form of a trigger, which is actuated with at least one finger and after exceeding a particular pressure threshold, a pressure on the trigger switch effects function setting, wherein, when the pressure threshold is exceeded, the function setting can be configured so as to be variable in a linear manner with changes in pressure. A "tool holding unit" should be understood in particular as meaning a unit of the portable power tool, in particular battery-powered power tool, which is provided to hold and fasten an application tool, for example a bit of a screwdriver or a drill bit. In particular, the tool holding unit has for this purpose an advantageously at least substantially cylindrical holding region for the tool. The tool holding unit is arranged in particular on an upper housing of the portable power tool, in particular of a battery-powered power tool.

It is proposed that a center axis of the tool holding unit extends at least through a vicinity of the actuating element. A "center axis of the tool holding unit" should be understood in particular as meaning an infinitely extending straight line that extends centrally through the holding region for the tool in an orientation direction of a held tool. In particular, the center axis of the tool holding unit corresponds to a force action line of the portable power tool. A "vicinity" should be understood in particular as meaning a region around the actuating element, said region being delimited by a distance of at most 5 mm from the actuating element. As a result of the configuration according to the disclosure of the portable power tool, improved guidance of a portable power tool and improved gripping ergonomics can be achieved in particular.

It is furthermore proposed that the center axis of the tool holding unit extends through the actuating element. Improved guidance of a battery-powered power tool and improved gripping ergonomics can be achieved in particular.

Furthermore, a pistol grip is proposed. A "pistol grip" should be understood in particular as meaning a handle for single-handed guidance of the portable power tool, said handle projecting in an at least substantially perpendicular manner from an upper housing component which has the tool holding unit, wherein an operator can actuate an actuating element of the portable power tool with one or more fingers of a hand with which he grasps the pistol grip in order to guide the portable power tool, without releasing a grip around the pistol grip. The expression "at least substantially perpendicular" should be understood in particular as meaning that an angle between the pistol grip and the upper housing component deviates from 90 degrees by at most 20, advantageously by at most 10 and preferably by at most one degree. In particular, the pistol grip can project from the upper housing component at an angle of 90 degrees. Advantageous gripping ergonomics can be achieved in particular.

It is furthermore proposed that the actuating element is arranged in an actuating finger protective space. An "actuating finger protective space" should be understood in particular as meaning a space which is delimited on at least three sides by a housing of a portable power tool and is provided to receive at least one finger of an operator of the portable power tool and to provide at least one guide region for the finger during actuation of the actuating element, and also preferably to additionally protect the finger from any injuries, in particular on account of pieces of material flying around during use of the portable power tool or on account of the portable power tool slipping. Advantageous guidance and protection of the finger during actuation of the actuating element can be achieved in particular.

It is furthermore proposed that the actuating finger protective space is configured in a closed manner on at least four sides. Preferably, the actuating finger protective space is delimited and closed on one side by a connecting bar. In particular, the side delimited by the connecting bar is formed by a side, located in a ventral direction, of the actuating finger protective space. A "ventral direction" should be understood in particular as meaning a direction extending perpendicularly to the center axis of the tool holding unit, the handle substantially extending in said direction. Advantageous guidance of the finger when resting against the actuating element can be achieved in particular.

It is furthermore proposed that the actuating finger protective space has a height extent of at least 2 cm. A "height extent" of the actuating finger protective space should be understood in particular as meaning an extent of the actuating finger protective space in a direction perpendicular to an actuating direction of the actuating element, a finger width extending in said direction when a finger rests against the actuating element. In particular, the actuating finger protective space has a height extent which allows the actuating element to be actuated with two fingers. Safe guidance of a portable power tool and safe actuation of the actuating element can be achieved in particular.

Furthermore, at least one drive motor is proposed which is arranged at least partially in a region located behind the actuating element, as seen from the tool holding unit. In particular, the drive motor is provided to drive a tool mounted in the tool holding unit. Preferably, the drive motor is formed by an electric motor and particularly preferably by a brushless DC motor (BLDC motor) which is supplied with power in particular by a rechargeable battery of a battery-powered power tool. The fact that the drive motor "is arranged at least partially in a region located behind the actuating element, as seen from the tool holding unit" should be understood in particular as meaning that the drive motor is arranged at least partially in a region of a portable power tool which is located on a projection of the actuating element, said projection extending parallel to the center axis and in a direction away from the tool holding unit. Improved guidance of a portable power tool and improved gripping ergonomics can be achieved in particular.

Furthermore, a handle is proposed, within which the drive motor is at least substantially arranged. The expression "arranged at least substantially within the handle" should be understood in particular as meaning that at least seventy, advantageously at least ninety and particularly preferably one hundred percent of the volume of the drive motor is located within the handle. Preferably, the handle is formed by a pistol grip. On account of the arrangement of the drive motor in the handle, improved guidance of a portable power tool and improved gripping ergonomics can be achieved in particular.

It is furthermore proposed that the center axis of the tool holding unit extends through the drive motor. Improved guidance of a battery-powered power tool and improved gripping ergonomics can be achieved in particular.

Furthermore, at least one connecting drive train unit for transmitting force from the drive motor to the tool holding unit is proposed, wherein the connecting drive train unit is guided past the actuating element and in particular past the actuating finger protective space. A "connecting drive train unit" should be understood in particular as meaning a unit having at least one connecting drive train for force transmission, said connecting drive train being configured in a substantially rod-like manner and being mounted preferably in a rotatable manner, said unit being connected at one end to the drive motor and being driven by the latter, and being connected at another end to the tool holding unit and transmitting a force of the drive motor to the latter. A gear unit may be arranged upstream or downstream of the connecting drive train, in the direction of the flow of force from the drive motor to the tool holding unit, wherein said gear unit is arranged preferably between the connecting drive train and the tool holding unit. The connecting drive train unit transmits in particular forces from the drive motor to the gear unit in order to drive the tool holding unit and/or to drive an application tool held in the tool holding unit. The expression "guided past" should be understood in particular as meaning that, in particular on account of a position of the at least one actuating element on the portable power tool, a path of the force transmission from the drive motor to the tool holding unit turns out longer than a path of the force transmission in the case of a hypothetical course of the connecting drive train unit through the position of the actuating element on the portable power tool, wherein, in the case of the hypothetical course of the connecting drive train unit through the position of the actuating element on the portable power tool, the connecting drive train extends in particular completely within the housing of the portable power tool, apart from a passage through a possible actuating finger protective space. Preferably, the connecting drive train unit is arranged in a manner separated from the actuating element by a housing of the portable power tool. In particular, as viewed in a machining direction, the drive motor is arranged at least partially in front of the actuating element, the gear unit is arranged at least partially behind the actuating element and preferably the actuating element is arranged completely in a region between the drive motor and the gear unit. A "machining direction" should be understood in particular as meaning a direction within the portable power tool along the center axis of the tool holding unit toward the tool holding unit. Preferably, the connecting drive train unit is guided past the actuating element above the latter. The term "above" should be understood in particular as meaning arranged on a side, facing the top side of the portable power tool and remote from the handle, of the actuating element. In principle, the connecting drive train unit can also be guided past the actuating element below the latter, to the left of the latter or to the right of the latter. Preferably, the connecting drive train unit extends at least substantially parallel to the center axis of the tool holding unit and parallel to a longitudinal extent of an actuating finger protective space in which the actuating element is arranged. Preferably, the gear unit and drive motor are arranged such that a shortest connecting line, arranged within the battery-powered power tool, between the gear unit and the drive motor deviates from a straight line. Advantageously space-saving and ergonomically advantageous positioning of the drive motor can be achieved in particular.

Furthermore a gear unit is proposed which is arranged between the connecting drive train unit and the tool holding unit. A "gear unit" should be understood in particular as meaning a unit having at least one gear, for example a planetary gear, wherein the gear unit may have further elements, for example a notched disk, a percussion screw mechanism or a hammer mechanism. The gear unit is provided to adapt a rotational speed of an output drive of the drive motor and/or of the connecting drive train unit to a rotational speed of the application tool and/or of the tool holding unit via a constant and/or variable transmission ratio. A flexible portable power tool can be achieved in particular in a structurally simple manner.

Furthermore, at least one angular gear unit is proposed which connects the connecting drive train unit to the drive motor. An "angular gear unit" should be understood in particular as meaning a gear unit which changes a rotational movement at least in one direction. In particular, the angular gear unit is provided to connect a drive motor, which is arranged in the handle and is oriented at least substantially in a direction perpendicular to the center axis of the tool holding unit, to a connecting drive train unit extending at least substantially parallel to the center axis, and to transmit a rotational movement of the output shaft of the drive motor to the connecting drive train unit. Advantageously space-saving and ergonomic positioning of the drive motor can be achieved in particular in a structurally simple manner.

The portable power tool according to the disclosure is not intended to be limited to the above-described application and embodiment. In particular, the portable power tool according to the disclosure can have a number of individual elements, components and units which differs from the number mentioned herein in order to fulfill a functionality described herein.

BRIEF DESCRIPTION OF THE DRAWINGS

Further advantages can be gathered from the following description of the drawing. Six exemplary embodiments of the disclosure are illustrated in the drawing. The drawing, the description and the claims contain numerous features in combination. A person skilled in the art will expediently also consider the features individually and combine them to form appropriate further combinations.

In the drawing.

DETAILED DESCRIPTION

Figure 1:
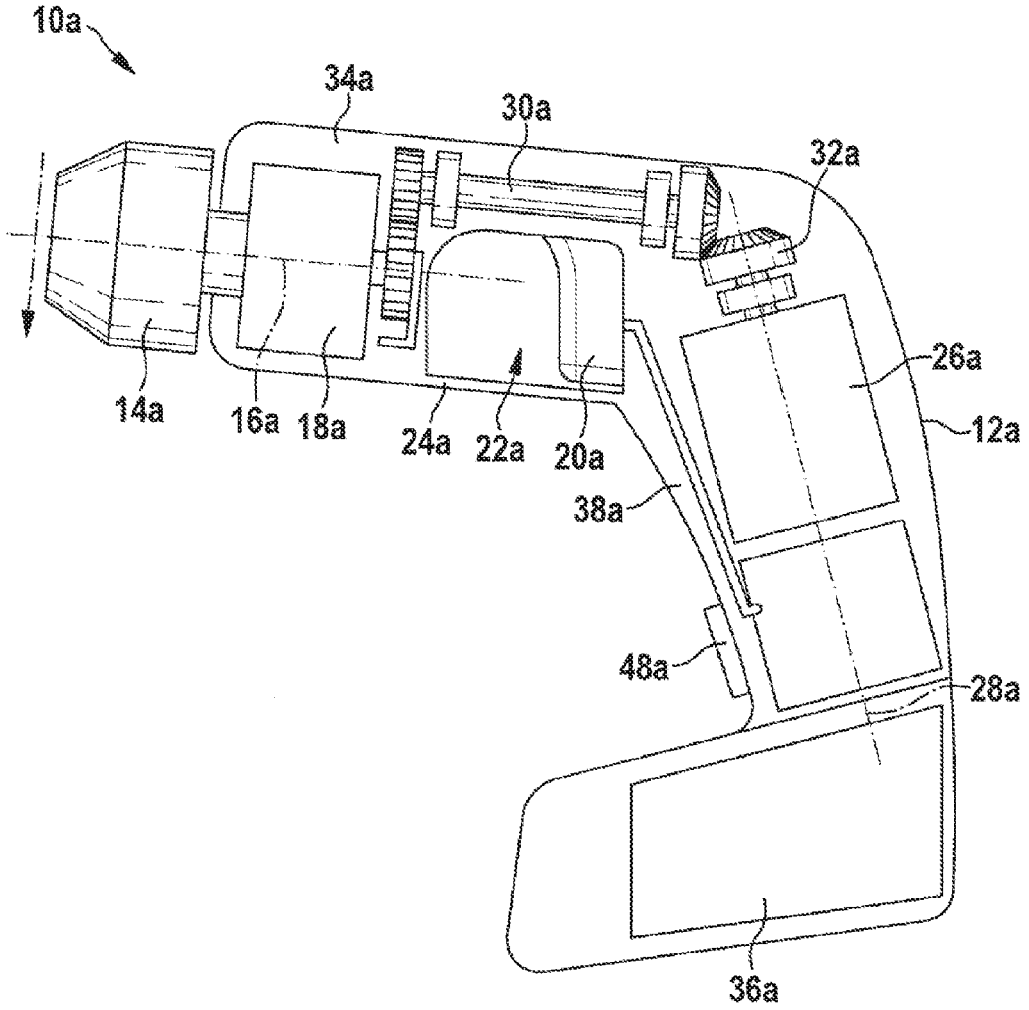
FIG. 1 shows a portable power tool according to the disclosure, configured as a battery-powered power tool, in a pistol form.

FIG. 1 shows a portable power tool according to the disclosure, which is configured as a battery-powered power tool 10*a*. The battery-powered power tool 10*a* is configured as a battery-powered screwdriver. The battery-powered power tool 10*a* is configured in a pistol form and has a handle 38*a* by way of which the battery-powered power tool 10*a* is grasped in order to be used and guided. The battery-powered power tool 10*a* is intended to be guided in a single-handed manner by grasping the handle 38*a*, wherein in principle a second hand of an operator can be used to guide the battery-powered power tool 10*a*, for example in order to grasp an upper housing component 34*a*. The handle 38*a* is embodied as a pistol grip 12*a*. In the example shown, the battery-powered power tool 10*a* comprises an actuating element 20*a* and a tool holding unit 14*a* which is provided to hold a screw for screwing in. A power supply unit 36*a* formed by a rechargeable battery is arranged in the handle 38*a* in a lower region which faces the ground during normal operation and faces away from the upper housing component 34*a*. In alternative configurations, instead of a power supply unit 36*a* configured as a rechargeable battery, use can be made for example of a power supply unit 36*a* configured as a battery. The lower region in which the power supply unit 36*a* is arranged is configured in a manner projecting forward, as seen in a direction toward the tool holder. Arranged on the handle 38*a* above the projecting, lower region is a further actuating element 48*a*, which interacts with the actuating element 20*a* in order to switch on and/or set the battery-powered power tool 10*a*. In alternative configurations, it is possible to dispense with the further actuating element 48*a*.

A center axis 16*a* of the tool holding unit 14*a* extends through the actuating element 20*a* and thus through a vicinity of the actuating element 20*a*. In alternative configurations of the battery-powered power tool 10*a*, the center axis 16*a* of the tool holding unit 14*a* can also extend for example at a distance of 5 mm above an upper end of the actuating element 20*a* or at a short distance therefrom. The center axis 16*a* of the tool holding unit 14*a* is at a distance from a center point of the actuating element 20*a* and two thirds of a longitudinal extent of the actuating element 20*a* extend on a side, facing the handle 38*a*, of the center axis 16*a*, said side facing the ground during normal operation. The actuating element 20*a* thus extends largely on a side, facing the handle 38*a*, of the center axis 16*a*, said side facing the ground during normal operation. As a result of such a course of the center axis 16*a*, advantageous ergonomics when the actuating element 20*a* is actuated and the battery-powered power tool 10*a* is guided can be achieved, since a force action line of the battery-powered power tool 10*a*, which extends along the center axis 16*a* of the tool holding unit 14*a*, extends through a hand of an operator and beneath at least one actuating finger of the operator, as a result of which undesired torques on the hand can be avoided.

The battery-powered power tool 10*a* has an actuating finger protective space 22*a* in which the actuating element 20*a* is arranged. The center axis 16*a* of the tool holding unit 14*a* thus also extends through the actuating finger protective space 22*a*. The actuating finger protective space 22*a* is formed in a closed manner on a side extending parallel to the center axis (16*a*) and facing the handle 38*a* and is closed there by a connecting bar 24*a* between two subregions of the upper housing component 34*a*. The connecting bar 24*a* is arranged on a side of the center axis 16*a* of the tool holding unit 14*a*, which side faces the ground in a normal operating state, and provides a bearing surface for an actuating finger of the operator and protection against any sharp edges or splinters in an environment. The actuating finger protective space 22*a* has a height extent of 5 cm, as a result of which actuation of the actuating element 20*a* by means of two fingers is possible. The height extent is formed by an extent of the actuating finger protective space 22*a* perpendicular to a longitudinal extent of the actuating finger protective space 22*a* and extending in a substantially perpendicular manner to the center axis 16*a* of the tool holding unit 14*a*, said extent of the actuating finger protective space 22*a* extending parallel to a surface normal of the ground in a normal operating state of the battery-powered power tool 10*a*. In principle, the actuating finger protective space 22*a* can have a smaller height extent in alternative configurations, such that the actuating element 20*a* can be actuated only with one actuating finger.

The battery-powered power tool 10*a* comprises a drive motor 26*a* which is arranged at least partially in a region located behind the actuating element 20*a* as seen from the tool holding unit 14*a*. In the case of a projection of the actuating element 20*a* in a direction leading away from the tool holding unit 14*a* and extending parallel to the center axis 16*a*, approximately half of the drive motor 26*a* is located within a region intersected by the projection and a further half extends downward, i.e. in a direction toward the ground in a normal operating state, in the direction of the handle 38*a*. The drive motor 26*a* is arranged within the handle 38*a*. The center axis 16*a* of the tool holding unit 14*a* extends through the drive motor 26*a* and passes through the latter in an upper region facing a top side of the battery-powered power tool 10*a*. The top side of the battery-powered power tool 10*a* is arranged opposite the handle 38*a* and in a manner facing away from the handle 38*a*. A motor axis 28*a* of the drive motor 26*a* encloses an angle of 70 degrees with the center axis 16*a* of the tool holding unit 14*a*.

The battery-powered power tool 10*a* furthermore has a connecting drive train unit 30*a* for transmitting force from the drive motor 26*a* to the tool holding unit 14*a*, said connecting drive train unit 30*a* extending substantially to the side of the actuating finger protective space 22*a*. The connecting drive train unit 30*a* has a rotatably mounted connecting drive train which is connected at one end to a gear and at a further end has a rotating disk having a beveled surface which meshes with a similarly configured rotating disk having a beveled surface of an output shaft of the drive motor 26*a*. The rotating disks form an angular gear unit 32*a* of the battery-powered power tool 10*a*, which connects the connecting drive train unit 30*a* to the drive motor 26*a*. A gear unit 18*a* connects the connecting drive train unit 30*a* to the tool holding unit 14*a* and is provided to adapt a rotational speed of the output shaft of the drive motor 26*a* to a provided rotational speed of the tool holding unit 14*a* by means of a constant and/or variable transmission ratio. The gear unit 18*a* may be configured for example as a planetary gear, wherein the connecting drive train unit 30*a* drives for example a sun gear or planet gear, an internal gear or a planet carrier. In alternative configurations, the battery-powered power tool 10*a* may be configured for example as a battery-powered percussion screwdriver or as a battery-powered percussion drill and the gear unit 18*a* may to this end comprise for example instead of or in addition to a screwdriver gear, a gear having a percussion screw mechanism, a gear having a notched disk for percussion drilling or a gear having a hammer mechanism.

FIGS. 2 to 6 show five further exemplary embodiments of the disclosure. The following descriptions and the drawings are limited substantially to the differences between the exemplary embodiments, with reference being made in principle also to the drawings and/or the description of the other exemplary embodiments, in particular FIG. 1, with regard to identically designated components, in particular with regard to components having identical reference signs. In order to distinguish between the exemplary embodiments, the letter a is positioned after the reference signs of the exemplary embodiment in FIG. 1. In the exemplary embodiments in FIGS. 2 to 6, the letter a is replaced by the letters b to f.

Figure 2:
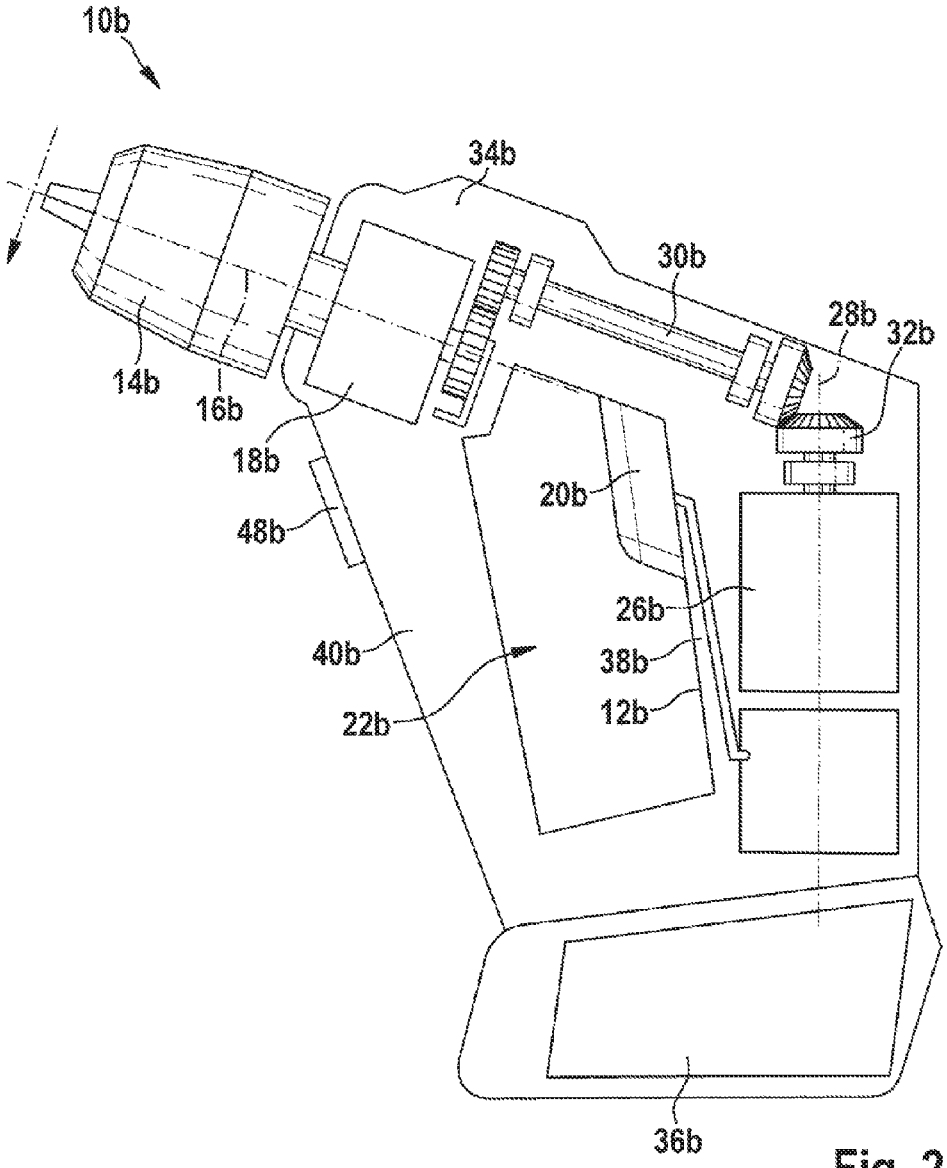
FIG. 2 shows an alternative configuration of a portable power tool having a grip protector for the handle.

The alternative embodiment of a battery-powered power tool 10*b* in FIG. 2 is substantially identical to the previous exemplary embodiment and differs therefrom only by an additional grip protection element 40*b* which extends from the upper housing component 34*b* in a normal operating state facing the ground and is arranged, in a viewing direction through the upper housing component 34*b* along a center axis 16*b* toward a tool holding unit 14*b*, behind a handle 38*b* configured as a pistol grip 12*b*. The grip protection element 40*b* is provided to afford additional protection to a hand of an operator who is grasping the handle 38*b* when guiding the battery-powered power tool 10*b*. A further actuating element 48*b* for actuating the battery-powered power tool 10*b* is arranged on the grip protection element 40*b*.

Figure 3:
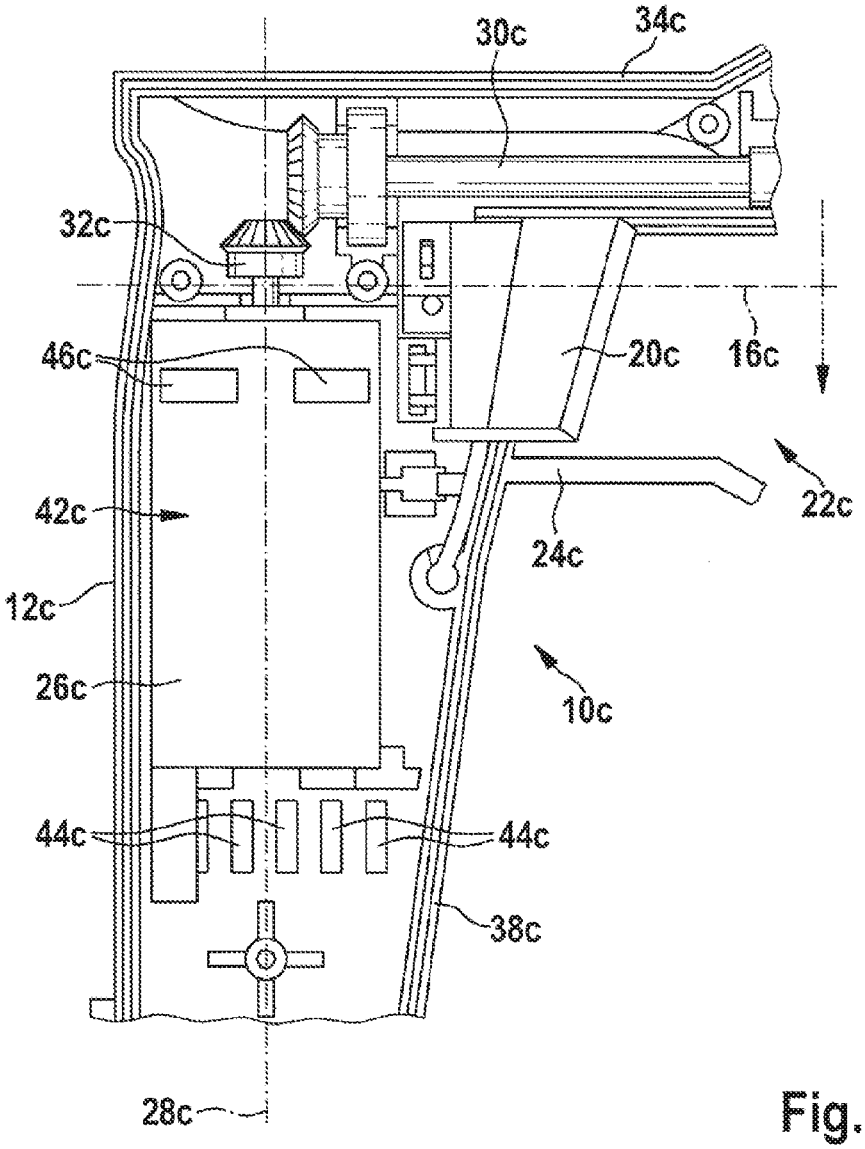
FIG. 3 shows an alternative configuration of a portable power tool having a drive motor, with an internal fan, arranged in a handle.
Figure 4:
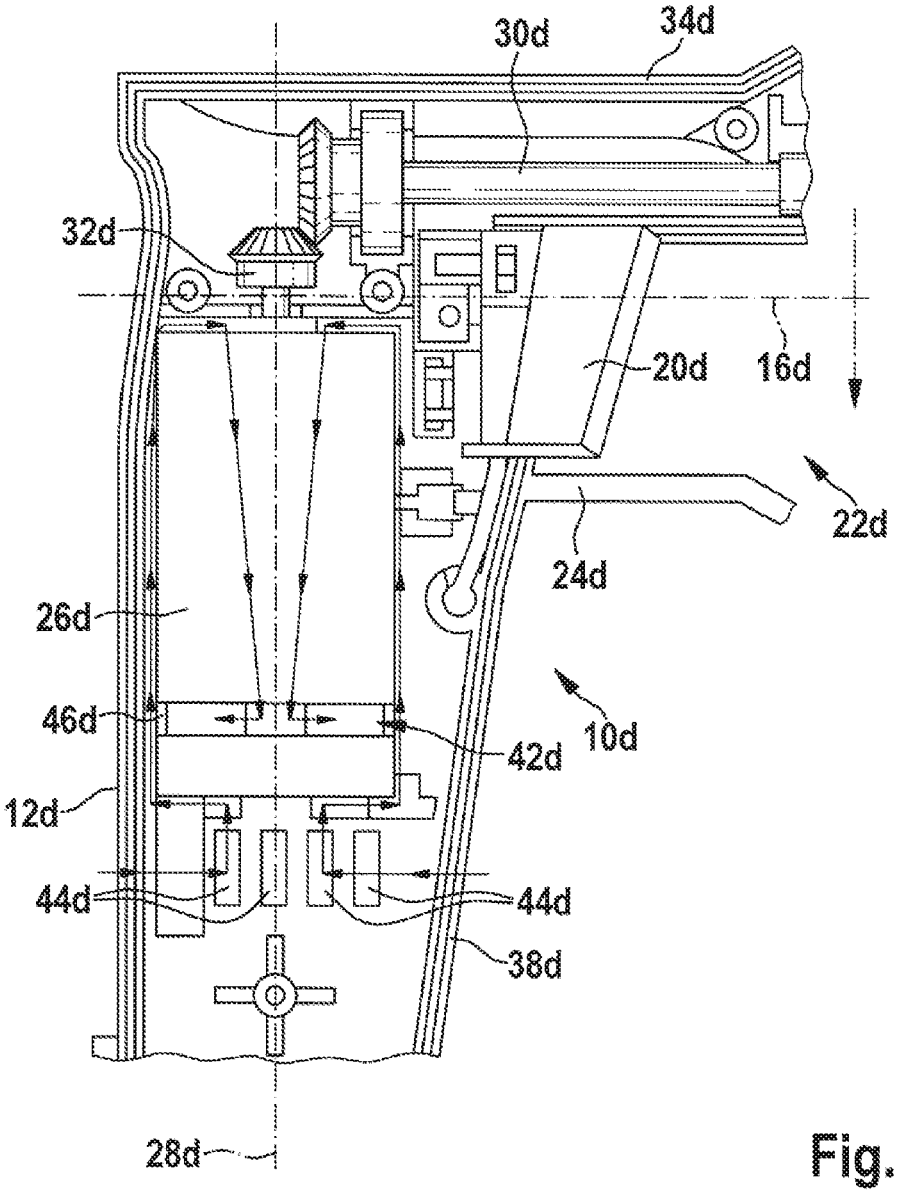
FIG. 4 shows a further alternative configuration of a portable power tool having a drive motor, with an internal fan, arranged in a handle.
Figure 5:
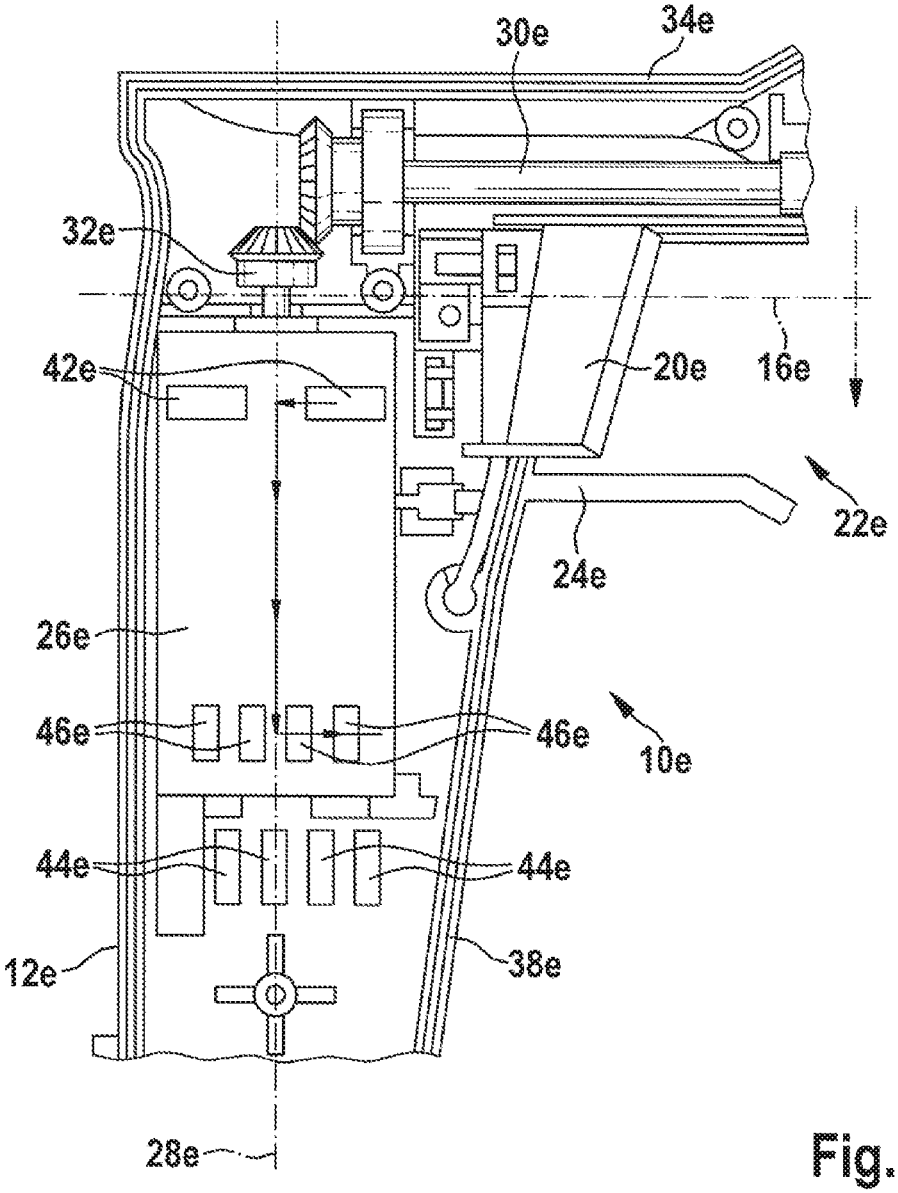
FIG. 5 shows a further alternative configuration of a portable power tool having a drive motor, with an internal fan, arranged in a handle.
Figure 6:
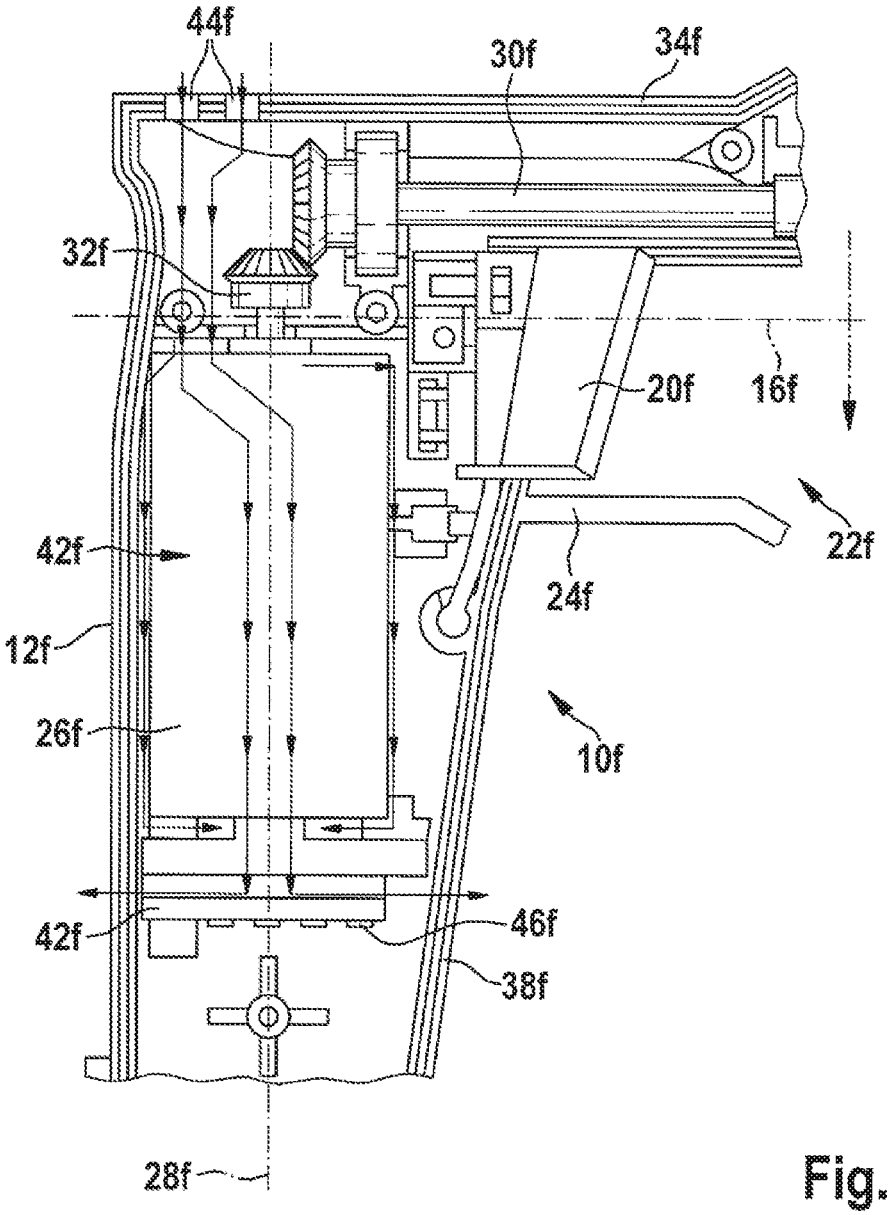
FIG. 6 shows an alternative configuration of a portable power tool having a drive motor, with an external fan, arranged in a handle.

FIG. 3 shows a detail of an alternative battery-powered power tool 10*c*, which is configured as a battery-powered screwdriver and is constructed in a manner substantially similar to the preceding exemplary embodiments. A center axis 16*c* of a tool holding unit (not illustrated in the detail shown) extends through a vicinity of and in particular directly through an actuating element 20*c* which is arranged in an actuating finger protective space 22*c*. The battery-powered power tool 10*c* comprises a handle 38*c* configured as a pistol grip 12*c*, within which a drive motor 26*c* is arranged, and an upper housing component 34*c* in which the actuating finger protective space 22*c* is arranged. The actuating finger protective space 22*c* is configured in a downwardly closed manner, i.e. on a side extending parallel to the center axis 16*c* and facing the handle 38*c*, by a connecting bar 24*c*. The drive motor 26*c* has a diameter of 28 mm and a length of 54 mm which is more than one and a half times the size of the diameter. The drive motor 26*c* is configured as what is known as a brushless DC motor, i.e. as a DC motor having an electronic circuit which replaces a mechanical commutator, otherwise necessary in DC motors, having brushes for reversing current in order to generate a rotating magnetic field from a direct current. The battery-powered power tool 10*c* furthermore comprises a fan unit 42*c* which is provided for ventilating and cooling the drive motor 26*c* and is integrated in the drive motor 26*c*. The fan unit 42*c* draws in air from a space outside the battery-powered power tool 10*c* via air passage openings 44*c* arranged on the handle 38*c* in a region beneath the drive motor 26*c*, i.e. on a side, facing away from the upper housing component 34*c*, of the drive motor 26*c*, in order to cool the drive motor 26*c*. Heated exhaust air is blown out through further air passage openings 46*c* which are arranged radially on an upper region of the drive motor 26*c*. The fan unit 42*c* is thus arranged partially in an upper region of the drive motor 26*c*. In principle, in an alternative configuration, air can also be drawn in via the further air passage openings 46*c* and blown out via the air passage openings 44*c*. The drive motor 26*c* is cooled from the inside by the integrated fan unit 42*c*. An angular gear unit 32*c* connects the drive motor 26*c* to a connecting drive train unit 30*c* and deflects a force flow from a direction of a motor axis 28*c* of the drive motor 26*c*, said axis extending perpendicularly to the center axis 16*c*, into a direction extending parallel to the center axis 16*c* of the connecting drive train unit 30*c*. In principle, the motor axis 28*c* can also include an angle not equal to 90 degrees with the center axis 16*c*.

In a further alternative embodiment (FIG. 4) of a battery-powered power tool 10*d*, the latter is configured in a manner substantially similar to the previous exemplary embodiment with an upper housing component 34*d* and a handle 38*d* configured as a pistol grip 12*d*. Arranged in the handle 38*d* is a drive motor 26*d* which is connected by means of an angular gear unit 32*d* to a connecting drive train unit 30*d* in the upper housing component 34*d*, wherein the angular gear unit 32*d* deflects a force flow from a direction of a motor axis 28*d*, said axis extending perpendicularly to a center axis 16*d*, into a direction of the connecting drive train unit 30*d* which extends parallel to the center axis 16*d*. In principle, the motor axis 28*d* can also include an angle not equal to 90 degrees with the center axis 16*d*. The connecting drive train unit 30*d* is guided past an actuating element 20*d* which is arranged in an actuating finger protective space 22*d* in the upper housing component 34*d*. The drive motor 26*d* has a diameter of 28 mm and a length of 54 mm which is more than one and a half times the size of the diameter. The drive motor 26*d* is configured as a brushless DC motor, i.e. as a DC motor having an electronic circuit which replaces a mechanical commutator, otherwise necessary in DC motors, having brushes for reversing current in order to generate a rotating magnetic field from a direct current. The battery-powered power tool 10*d* furthermore comprises a fan unit 42*d* which is provided for ventilating and cooling the drive motor 26*d* and is integrated in the drive motor 26*d*. The fan unit 42*d* is arranged in a lower region of the drive motor 26*d* and draws in air from a space outside the battery-powered power tool 10*d* via air passage openings 44*d* arranged on the handle 38*d* in a region beneath the drive motor 26*d*, i.e. on a side, facing away from the upper housing component 34*d*, of the drive motor 26*d*, in order to cool the drive motor 26*d*. Heated air is blown out via further air passage openings 46*d* arranged radially on the drive motor 26*d* in a lower region. In principle, in an alternative configuration, air can also be drawn in via the further air passage openings 46*d* and blown out via the air passage openings 44*d*. The air drawn in through the air passage openings 44*d* flows past the outside of the drive motor 26*d* and thus cools it from the outside and is guided from above, i.e. from a side facing the upper housing component 34*d*, through the drive motor 26*d* by the fan unit 42*d* for the purpose of cooling from the inside, before it is blown out through the air passage openings 46*d*. The drive motor 26*d* is thus cooled from the inside and the outside. The air passage openings 44*d*, 46*d* are arranged at a suitable distance from the actuating element 20*d* such that they are not covered by a hand of an operator when the battery-powered power tool 10*d* is guided in a single-handed manner as intended.

A further alternative embodiment (FIG. 5) of a battery-powered power tool 10*e* is configured in a manner substantially similar to the previous exemplary embodiment. A fan unit 42*e* for ventilating and cooling a drive motor 26*e* arranged in a handle 38*e* configured as a pistol grip 12*e* is integrated in the drive motor 26*e* and arranged in an upper region of the drive motor 26*e*. The fan unit 42*e* has an air passage opening 44*f* which is arranged above the drive motor 26*f* and draws in air from a space outside a battery-powered power tool 10*e* via air passage openings 44*e* arranged on the handle 38*e* in a region beneath the drive motor 26*e*, i.e. on a side, facing away from an upper housing component 34*e*, of the drive motor 26*e*, in order to cool the drive motor 26*e*. Heated air is blown out via further air passage openings 46*e* arranged radially on the drive motor 26*e* in a lower region. In principle, in an alternative configuration, air can also be drawn in via the further air passage openings 46*e* and blown out via the air passage openings 44*e*. The air drawn in through the air passage openings 44*e* flows past the outside of the drive motor 26*e* and thus cools it from the outside and is guided from above, i.e. from a side facing the upper housing component 34*e*, through the drive motor 26*e* by the fan unit 42*e* for the purpose of cooling from the inside, before it is blown out through the air passage openings 46*e*. The drive motor 26*e* is thus cooled from the inside and the outside. The air passage openings 44*e*, 46*e* are arranged at a suitable distance from the actuating element 20*e* such that they are not covered by a hand of an operator when a battery-powered power tool 10*e* is guided in a single-handed manner as intended.

In a further alternative embodiment (FIG. 6) of a battery-powered power tool 10*f*, a fan unit 42*f* for a drive motor 26*f* arranged in a handle 38*f* configured as a pistol grip 12*f* is arranged outside the drive motor 26*f*. The fan unit 42*f* is arranged beneath the drive motor 26*f*, i.e. in a region of the handle 38*f*, seen from which the drive motor 26*f* is located between the region and the upper housing component 34*f*. The fan unit 42*f* draws in air from a space outside a battery-powered power tool 10*f* via air passage openings 44*f* arranged on the handle 38*f* in a region beneath the drive motor 26*f*, i.e. on a side, facing away from an upper housing component 34*f*, of the drive motor 26*f*, in order to cool the drive motor 26*f*. Heated air is blown out via further air passage openings 46*f* arranged radially on the drive motor 26*f* in a lower region. In principle, in an alternative configuration, air can also be drawn in via the further air passage openings 46*f* and blown out via the air passage openings 44*f*. The air drawn in through the air passage openings 44*f* flows past the outside of the drive motor 26*f* and thus cools it from the outside and is guided from above, i.e. from a side facing the upper housing component 34*f*, through the drive motor 26*f* by the fan unit 42*f* for the purpose of cooling from the inside, before it is blown out through the air passage openings 46*f*. The drive motor 26*f* is thus cooled from the inside and the outside. The air passage openings 44*f*, 46*f* are arranged at a suitable distance from the actuating element 20*f* such that they are not covered by a hand of an operator when a battery-powered power tool 10*f* is guided in a single-handed manner as intended.

What is claimed is:

1. A portable power tool, comprising:

a housing;

a handle;

at least one actuating element disposed on the handle, the actuating element being configured to (i) switch the power tool on or off, or (ii) to set power values of the power tool;

at least one tool holding unit having a central longitudinal axis;

a drive motor arranged at least partially in a region located behind the at least one actuating element in a direction defined along the central longitudinal axis from a distal end to a proximal end of the at least one tool holding unit;

at least one connecting drive train unit operably connected to the at least one drive motor and the at least one tool holding unit and configured to transmit rotational force from the at least one drive motor to the at least one tool holding unit; and a gear unit arranged along a path of the rotational force between the at least one connecting drive train unit and the at least one tool holding unit, wherein the at least one tool holding unit is configured such that a portion of the central longitudinal axis extends through the at least one actuating element, wherein at least seventy percent of a volume of the drive motor is disposed within the handle, wherein the at least one connecting drive train unit is guided past the at least one actuating element, and wherein the actuating element is interposed between the gear unit and the drive motor in such a way that a line connecting a point of the gear unit to a point of the drive motor passes through the actuating element.

2. The portable power tool according to claim 1, wherein the drive motor is arranged at least partially in a projection of the actuating element, said projection extending parallel to the central longitudinal axis and in a direction away from the tool holding unit.

3. The portable power tool according to claim 1, wherein the housing includes an upper housing portion defining an opening in which the actuating element is positioned.

4. The portable power tool according to claim 3, wherein the housing further comprises a connecting bar positioned between the actuating element and the handle portion so as to close the opening when viewed in a cross-sectional view taken coincident with the central longitudinal axis such that the opening defines an actuating finger protective space.

5. The portable power tool according to claim 1, wherein the connecting drive train unit extends at least substantially parallel to the central longitudinal axis.

6. The portable power tool according to claim 1, wherein the actuating element is embodied as a trigger switch.

7. The portable power tool according to claim 1, wherein the housing is configured in a pistol form, and the handle is configured as a pistol grip of the pistol form.

8. The portable power tool according to claim 1, wherein the drive motor includes a motor longitudinal axis, which is transverse to the central longitudinal axis.

9. The portable power tool according to claim 1, wherein the drive motor is operably connected to the tool holding unit and configured to rotationally drive the tool holding unit about the central longitudinal axis.

10. The portable power tool according to claim 1, further comprising a pistol grip.

11. The portable power tool according to claim 1, further comprising:

an actuating finger protective space partially defined by the at least one actuating element.

12. The portable power tool according to claim 11, wherein the actuating finger protective space is closed on at least four sides when viewed from a side cross-section of the portable power tool cut along the central longitudinal axis.

13. The portable power tool according to claim 11, wherein the actuating finger protective space has a height extent, which is defined perpendicular to an actuating direction of the at least one actuating element, of at least 2 cm.

14. The portable power tool according to claim 1, wherein the central longitudinal axis of the at least one tool holding unit extends through the at least one drive motor.

15. The portable power tool according to claim 1, further comprising at least one angular gear unit operably connecting the at least one connecting drive train unit to the at least one drive motor.

16. The portable power tool according to claim 1, wherein the connecting drive train unit is spaced apart from the central longitudinal axis.

* * * * *